US005845659A

United States Patent [19]

Hutchins

[11] Patent Number: 5,845,659

[45] Date of Patent: Dec. 8, 1998

[54] LOTION APPLICATOR

[76] Inventor: Kelly Hutchins, 1100 S. 12th St. Apt. 3, Marion, Iowa 52302

[21] Appl. No.: 950,407

[22] Filed: Oct. 15, 1997

[51] Int. Cl.[6] ..... A45D 40/36

[52] U.S. Cl. ..... 132/317; 132/320; 401/218

[58] Field of Search ..... 132/317, 320; 401/6, 208, 218

[56] References Cited

U.S. PATENT DOCUMENTS

| | | | |
|---|---|---|---|
| D. 252,219 | 6/1979 | Peeples | 401/6 |
| 812,087 | 2/1906 | Peterson | 401/208 |
| 1,565,979 | 12/1925 | Bachrach | 401/208 |
| 2,029,056 | 1/1936 | Carlson | 401/208 |
| 3,075,230 | 1/1963 | Marchant | 401/218 |
| 3,302,279 | 2/1967 | Rosa | 401/218 |
| 4,150,904 | 4/1979 | Stewart | 401/6 |
| 4,571,106 | 2/1986 | Scuderi | 401/6 |
| 5,109,798 | 5/1992 | Impastato et al. | 401/208 |
| 5,240,339 | 8/1993 | DeForest et al. | 401/6 |
| 5,493,749 | 2/1996 | Zayas | 132/320 |

FOREIGN PATENT DOCUMENTS

| | | | |
|---|---|---|---|
| 65828 | 12/1982 | European Pat. Off. | 401/218 |
| 3447845 | 7/1986 | Germany | 132/320 |
| 2272186 | 5/1994 | United Kingdom | 132/320 |

*Primary Examiner*—Todd E. Manahan
*Assistant Examiner*—Eduardo C. Robert

[57] ABSTRACT

A lotion applicator, particularly adapted for applying suntan lotion or oil to the body of a user, includes an elongated handle in which a supply of lotion is stored and a cylindrically shaped sponge roller which facilitates an even distribution of lotion over the user's body. Lotion is delivered to the sponge roller by a plurality of freely rotatable applicator balls which are in communication with a reservoir of lotion. The balls are provided with grooves which allow them to more efficiently deliver lotion to the sponge roller, and the rotatable movement of the sponge roller effects the concurrent rotation of the applicator balls so as to maintain a continuous supply of lotion to the roller. The handle of the applicator is provided with a flexible neck portion which allows the handle to be angularly adjusted relative to the roller to thus increase the capability of the user to apply lotion to hard-to-reach areas of his or her body.

1 Claim, 3 Drawing Sheets

3
20
3
16
10
10
5
30
4
14
30
18
18
12
5
4

LOTION APPLICATOR

BACKGROUND OF THE INVENTION

1. Field of the Invention

The present invention relates to fluid dispensing devices and more particularly pertains to a portable applicator for suntan lotion.

2. Description of the Prior Art

The use of suntan lotion applicators is well known in the prior art. This is evidenced by the granting of a number patents relating to various functional and structural aspects of lotion applicators, and a review of these patents will show that most of the prior art applicators rely upon elongated handles with sponge applicators being attached to ends thereof. Typically, it is necessary to soak the sponge applicators with lotion before using the lotion applicator, and a manual reapplying of lotion is continually required by the user as lotion is applied over his or her entire body. There may also be patents evidencing the use of a lotion reservoir in fluid communication with a sponge applicator and accordingly, the basic concept of utilizing lotion applicators having lotion storing reservoirs in combination with body-contacting sponges may be known. However, there is no evidence that a lotion applicator has been developed which continually supplies a predetermined amount of lotion to a sponge applicator, whereby no manual reapplying of lotion to the sponge applicator is required by the user while at the same time, no excessive amounts of lotion are applied to the user's body. As such, there apparently still exists a need for these types of controlled lotion applicators, and in this respect, the present invention substantially fulfills this need.

SUMMARY OF THE INVENTION

In view of the foregoing disadvantages inherent in the known types of lotion applicators now present in the prior art, the present invention provides a new lotion applicator wherein the same can be utilized to a controllably and continually apply an even and precise amount of lotion to the body of a user. As such, the general purpose of the present invention, which will be described subsequently in greater detail, is to provide a lotion applicator and method which has many of the advantages of the lotion applicators mentioned heretofore and many additional novel features that result in a lotion applicator which is not anticipated, rendered obvious, suggested, or even implied by any of the prior art lotion applicators, either alone or in any combination thereof.

To attain this, the present invention generally comprises a lotion applicator, particularly adapted for applying suntan lotion or oil to the body of a user, that includes an elongated handle in which a supply of lotion is stored and a cylindrically shaped sponge roller which facilitates an even distribution the of lotion over the user's body. Lotion is delivered to the sponge roller by a plurality of freely rotatable applicator balls which are in communication with a reservoir of lotion. The balls are provided with grooves which allow them to more efficiently deliver lotion to the sponge roller, and the rotatable movement of the sponge roller effects the concurrent rotation of the applicator balls so as to maintain a continuous supply of lotion to the roller. The handle of the applicator is provided with a flexible neck portion which allows the handle to be angularly adjusted relative to the roller to thus increase the capability of the user to apply lotion to hard-to-reach areas of his or her body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lotion applicator and method which has many of the advantages of the lotion applicators mentioned heretofore and many novel features that result in a lotion applicator which is not anticipated, rendered obvious, suggested, or even implied by any of the prior art lotion applicators, either alone or in any combination thereof.

It is another object of the present invention to provide a new lotion applicator which may be easily and efficiently manufactured and marketed.

It is a further object of the present invention to provide a new lotion applicator which is of a durable and reliable construction.

An even further object of the present invention is to provide a new lotion applicator which is susceptible of a low cost of manufacture with regard to both materials and labor, and which accordingly is then susceptible of low prices of sale to the consuming public, thereby making such lotion applicators economically available to the buying public.

Still yet another object of the present invention is to provide a new lotion applicator which provides in the apparatuses and methods of the prior art some of the advantages thereof, while simultaneously overcoming some of the disadvantages normally associated therewith.

Still another object of the present invention is to provide a new and improved lotion applicator which facilitates the use of a control means which permits a controlled and precise dispensing of lotion to a sponge applicator associated with the lotion applicator.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF PREFERRED EMBODIMENT

Figures 1, 2:
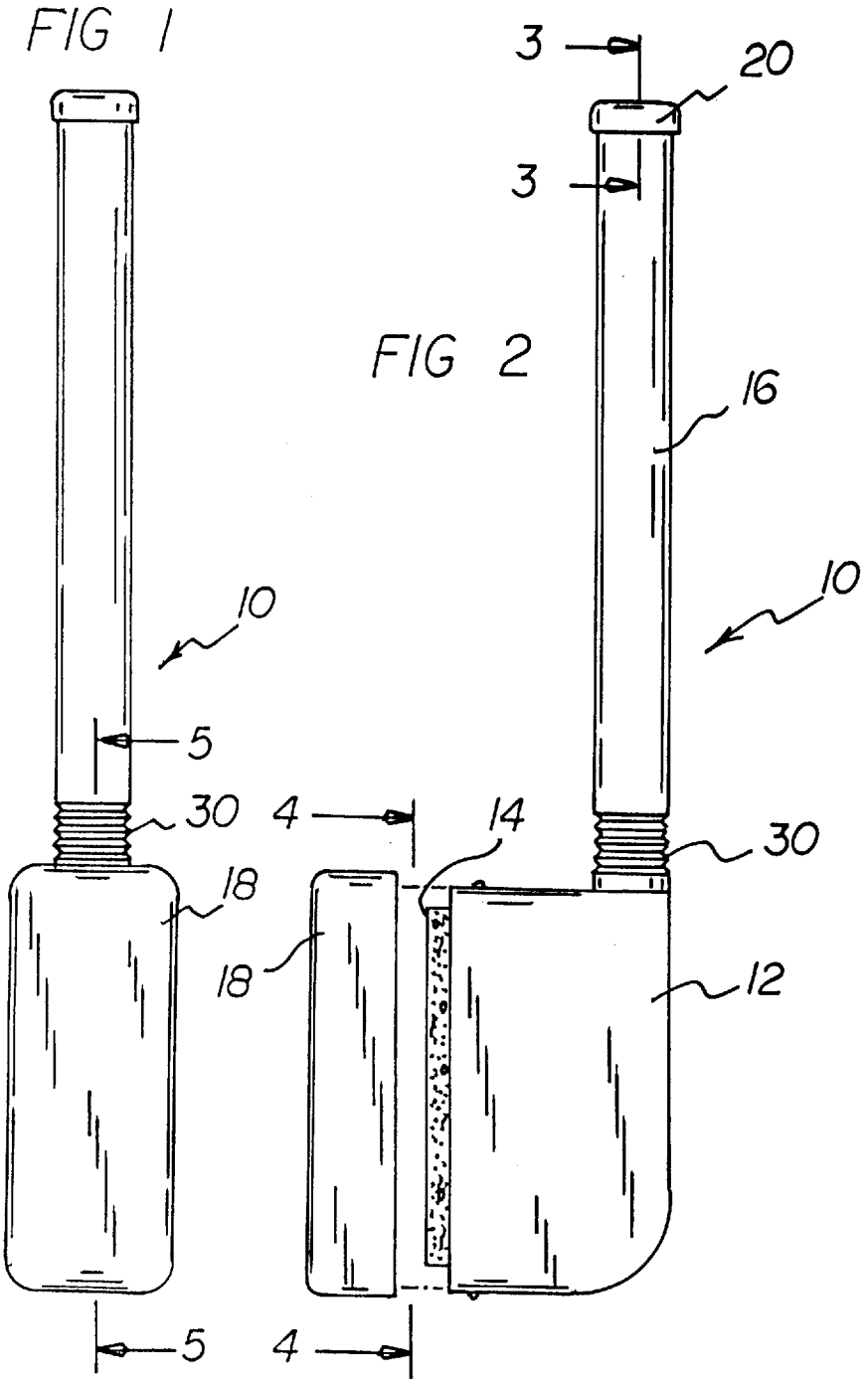
FIG. 1 is a front elevation view of the lotion applicator comprising the present invention.
FIG. 2 is side elevation view of the invention.

With reference now to the drawings, and in particular to FIGS. 1–4 thereof, a new lotion applicator embodying the principles and concepts of the present invention and generally designated by the reference numeral 10 will be described.

Figure 3:
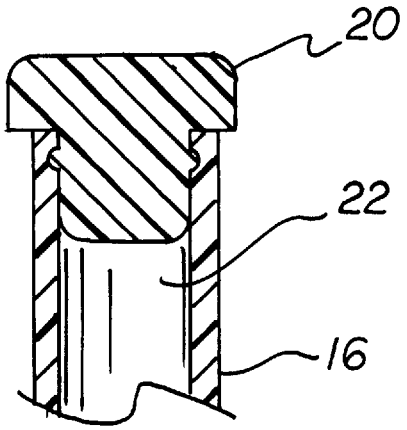
FIG. 3 is a cross-sectional view of the invention as viewed along the line 3—3 of FIG. 2.

More specifically, it will be noted that the lotion applicator 10 essentially consists of a lotion retaining housing 12 having a sponge roller 14 associated therewith and an elongated handle 16 fixedly attached to the housing. A conformingly shaped cap 18 may be snap-fitted over the housing 12 so as to protect the sponge roller 14, and the handle 16 is provided with a fill cap 20 which may be similarly snap-fitted into a hollow interior portion 22 of the handle, as shown in FIG. 3. The sponge roller 14 is mounted on an elongated flexible shaft 24 which extends over the axial length of the sponge roller and which is positionable through a pair of opposed through-extending apertures 26, 28 in the housing 12. The flexible shaft 24 may be manually deformed so as to be removable from the apertures 26, 28 and the housing 12, thereby to allow periodic maintenance or replacement of the sponge roller to occur.

FIGS. 1 and 2 also illustrate the fact that the elongated handle 16 is provided with an integral flexible neck portion 30. In the preferred embodiment, the handle 16 will be manufactured from a polymeric material, and the integral neck portion 30 can be designed in an accordion-like fashion whereby the handle, with minimal effort by the user, can be angularly displaced relative to the housing 12. This feature allows the handle 16 to be adjusted to a more convenient angle, whereby the sponge roller 14 can then be brought into contact with a hard-to-reach portion of a user's body.

Figure 4:
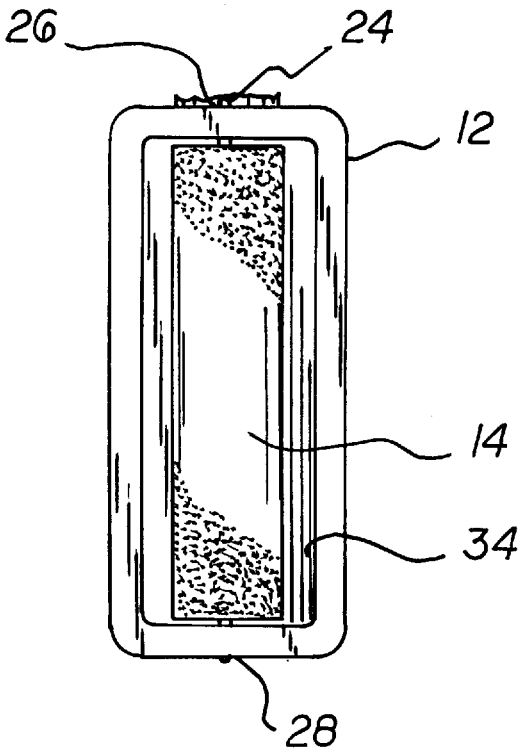
FIG. 4 is a cross-sectional view of the invention as viewed along line 4—4 of FIG. 2.
Figure 5:
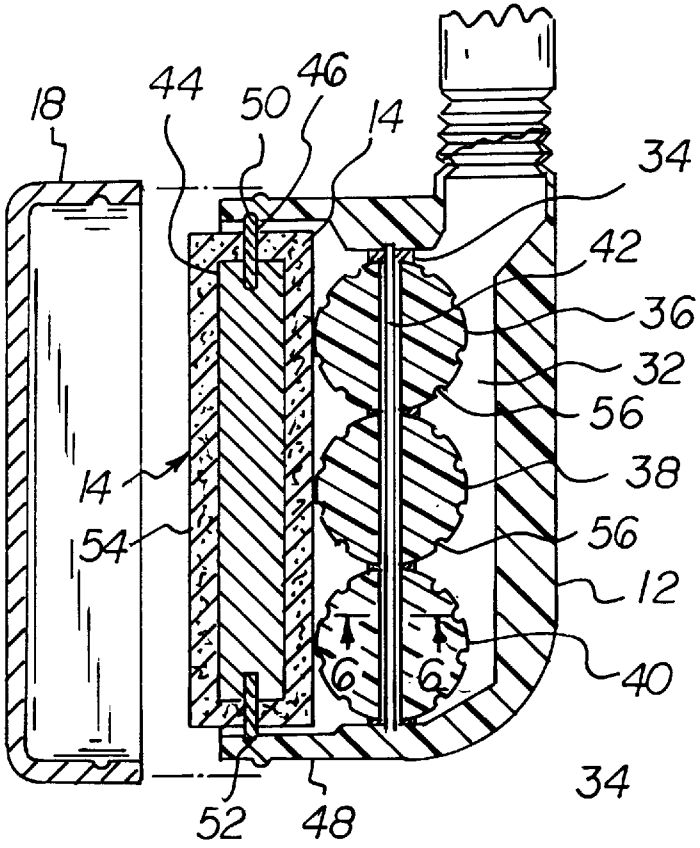
FIG. 5 is a cross-sectional view of the invention as viewed along the line 5—5 of FIG. 1.

The hollow interior 22 of the handle 16 serves as a lotion receiving and storage conduit and in this respect, it can be seen that the fill cap 20 can be manually removed when desired to facilitate the addition of lotion to the applicator 10. As shown in FIG. 5, lotion delivered to the hollow interior 22 of the handle 16 will be stored in a reservoir area 32 formed in the housing 12. A fluid tight wall 34, as shown in FIGS. 4 and 5, prevents the lotion from spilling out of the housing 12 around the sponge roller 14. Several freely rotatable applicator balls 36, 38, 40 are axially aligned on a through-extending shaft 42 wherein such shaft extends completely through central portions of each of the applicator balls as well as an aligned aperture extending through the fluid tight wall 34. The applicator balls 36, 38, 40 serve as seals which prevent lotion from moving out of the reservoir 32 into contact with the sponge roller 14.

FIG. 5 also illustrates a modified embodiment of the sponge roller 14 wherein the through-extending shaft 24 discussed in FIG. 4 is divided into three parts, i.e., a firm rubber cylindrically-shaped center portion 44 having oppositely disposed metallic and axially aligned shaft members 46, 48 positionable within respective detents 50, 52 integrally formed in the housing 12. The rubber center portion 44 allows for the manual deformation of the sponge roller 14 for purposes of replacement or cleaning, and also creates a more solid and firm contact between the sponge roller and the outer surfaces of each of the applicator balls 36, 38, 40. In this regard, when the sponge 14 is rolled over the body of a user, an outer sponge surface 54 of the roller transfers lotion to the user's body while at the same time causing a frictional torque to be applied to each of the applicator balls 36, 38, 40 inasmuch as the sponge surface is in frictional communication therewith.

As can now be understood by carefully reviewing FIG. 5, the rotational movement of the sponge roller 14 results in a concurrent rotational movement of each of the applicator balls 36, 38, 40. The outer peripheral surfaces of the applicator balls 36, 38, 40 are in fluid communication with the lotion retained in the reservoir 32, and this lotion is then transferred by a continual rotational movement of the applicator balls out of the reservoir and into engagement with the sponge surface 54 of the sponge roller 14. Accordingly, a continual supply of lotion is delivered from the reservoir 32 to the sponge roller 14 where it is absorbed by the sponge surface 54 and then controllably and selectively transferred to the skin of a user of the applicator 10.

Figure 6:
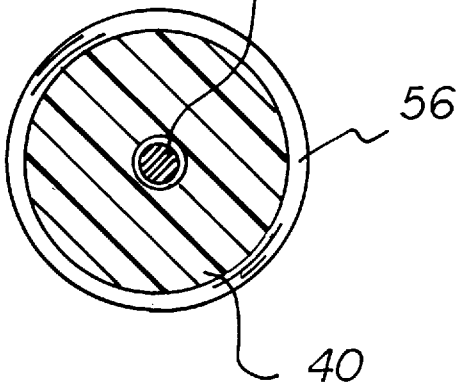
FIG. 6 is cross-sectional view of the invention as viewed along the line 6—6 of FIG. 5.

To assure that a continual and predetermined supply of lotion is delivered from the reservoir 32 to the sponge roll 14, each of the applicator balls 36, 38, 40 are provided with circular grooves, all of which are generally designated by the reference numeral 56 and all of which extend completely around various circumferential portions of the applicator balls. These grooves 56 are particularly shown in FIGS. 5 and 6 and as is now apparent, the grooves serve as shallow conduits which facilitate a continual delivery of lotion from the reservoir 32 to the roller 14 as the applicator balls rotate on the shaft 42.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lotion applicator comprising:

lotion;

handle means;

lotion storage means forming a part of said handle means; and applicator means for selectively dispensing said lotion from said lotion storage means onto said body of said user, said applicator means including a body contacting rotatable applicator, said rotatable applicator being in fluid contact with said lotion within said lotion storage means and being operable to selectively deliver said lotion to said body of said user during a rolling motion of said rotatable applicator across an area of said body of said users wherein said rotatable applicator is formed from a resilient absorbent material, thereby to enhance the capability of said rotatable applicator to absorb and transmit said lotion from said lotion storage means to said body of said user;

said resilient absorbent material being a sponge;

wherein lotion is selectively dispensed from said lotion storage means to said rotatable applicator by a plurality of applicator balls, said plurality of applicator balls being rotatably mounted in axial alignment in a fluid tight wall forming a part of said lotion storage means, said plurality of applicator balls being in an abutting relationship to said rotatable applicator and being operable to obtain a coating of said lotion during a rotation thereof, thereby to continually selectively deliver said lotion coating to said rotatable applicator from said lotion storage means;

said rotation of said plurality of applicator balls being facilitated by a rotation of said rotatable applicator while in said abutting relationship with said plurality of applicator balls;

said rotatable applicator being removably fastened to said handle means, thereby to facilitate a replacement of said rotatable applicator when desired, wherein the rotatable applicator is mounted on a flexible shaft which is manually deformed so as to be removed from apertures formed in the housing;

said plurality of applicator balls each being provided with concentric circular surface grooves which extend completely around various circumferential portions of the applicator balls, thereby to increase an amount of lotion delivered from said lotion storage means to said rotatable applicator during concurrent rotation of said plurality of applicator balls and said rotatable applicator;

said handle means including an adjustable section, whereby a desired angular relationship between said rotatable applicator and said handle means can be achieved, thereby to improve a capability for reaching difficult portions of said body of said user;

said adjustable section being proximate said rotatable applicator and said handle being of an elongated construction;

said adjustable section being of an accordion-like design, thereby to facilitate a manual positioning of said rotatable applicator relative to said handle means;

said rotatable applicator being of a cylindrical roller shape.

* * * * *